United States Patent [19]

Forrest

[11] 4,205,029

[45] May 27, 1980

[54] PRE-STRESSED CONCRETE CONSTRUCTION

[76] Inventor: Esli J. Forrest, 54 Winetere Rd., Papatoetoe, Auckland, New Zealand

[21] Appl. No.: 867,296

[22] Filed: Jan. 5, 1978

Related U.S. Application Data

[63] Continuation of Ser. No. 773,327, Mar. 1, 1977, abandoned, which is a continuation of Ser. No. 645,457, Dec. 30, 1975, abandoned, which is a continuation of Ser. No. 545,161, Jan. 29, 1975, abandoned.

[30] Foreign Application Priority Data

Feb. 6, 1974 [AU] Australia ..... PB6480

[51] Int. Cl.[2] ..... B28B 23/04; B28B 21/60

[52] U.S. Cl. ..... 264/34; 52/223 R; 264/35; 264/228; 264/38

[58] Field of Search ..... 264/228, 256, 308, DIG. 57, 264/34.35; 52/223 R

[56] References Cited

U.S. PATENT DOCUMENTS

| | | | |
|---|---|---|---|
| 978,617 | 12/1910 | Mitats | 264/DIG. 57 |
| 2,702,424 | 2/1955 | Bakker | 264/228 |

FOREIGN PATENT DOCUMENTS

| | | | |
|---|---|---|---|
| 559136 | 6/1958 | Canada | 52/223 R |

OTHER PUBLICATIONS

Tensile Bond Strength Between Aggregate & Cement Paste or Mortar, T. T. C. Hsu, ACI Journal, Apr. 1963, pp. 465–486.

Strength & Deformation Properties of Autogenously Healed Motars, R. K. Dhir., ACI Journal, Mar. 1973, pp. 231–236.

The Chemistry of Cement & Concrete, F.M. Lea, Edward Arnold (Publishers) Ltd., 3rd Ed., pp. 239–269, 1970.

Cement & Concrete, H. J. Gilkey, pp. 7–20–7–23.

Autogenous Healing of Concrete in Compression, E. F. Whitlam, The Structural Engineer, pp. 235–243.

*Primary Examiner*—Thomas P. Pavelko

*Attorney, Agent, or Firm*—Cushman, Darby & Cushman

[57] ABSTRACT

The invention relates to a method of forming a pre-stressed concrete member in which at least a bonding surface of a pre-cast concrete shell has the hydration process therein temporarily arrested by means of heat applied thereto such that reactivation of the hydration process after the stressing of the shell and prior to the pouring into the shell of infilling concrete, results in a strong bond being formed between the bonding surface of the pre-cast concrete element and the infilling concrete. The construction joints between the infilling concrete and the pre-cast concrete shell are thus of an improved integrity.

4 Claims, 6 Drawing Figures

PRE-STRESSED CONCRETE CONSTRUCTION

This is a continuation of application Ser. No. 773,327 filed Mar. 1, 1977, which is a continuation of Ser. No. 645,457, filed Dec. 30, 1975, which is a continuation of Ser. No. 545,161, filed Jan. 29, 1975, all now abandoned.

This invention relates to improvements in and relating to pre-stressed concrete construction and more particularly to pre-stressed concrete beams, slabs and other concrete members.

It is an object of one embodiment of this invention to provide an improved pre-stressed concrete construction member and a method of forming thereof which does not require the normal pre-stressing procedure, which is usually costly, time consuming and limiting on structural capacity.

It is a further object of this invention to provide a pre-stressed concrete construction member comprising composite pre-cast and in-situ concrete elements, having an improved load capacity and in which the construction joints between the concrete components of the beam are of an improved integrity which integrity being due to the interrupted hydration of the concrete in the pre-cast concrete element.

Further objects of this invention will become apparent from the following description.

According to one aspect of this invention there is provided a method of forming a pre-stressed concrete member comprising:

forming a concrete shell;

curing said concrete shell for a pre-selected time and drying out at least one surface of said concrete shell so as to temporarily arrest hydration therein;

locating and stressing one or more stressing members within the shell so as to stress the shell to a predetermined stress pattern; dampening said at least one surface of the shell;

infilling the shell with concrete so as to cover the stressing member(s);

allowing the infilling concrete and the concrete shell to cure concurrently.

Figure 1:
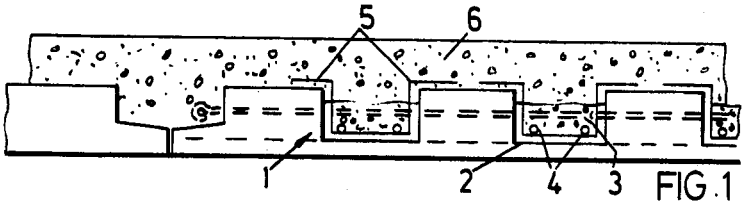

Further aspects of this invention, which should be considered in all its novel aspects, will become apparent from the following description, given by way of example of a preferred embodiment of the invention and in which reference is made to the accompanying drawings, wherein:

FIG. 1: shows a flat concrete slab incorporating a pre-stressed concrete construction member according to one embodiment of this invention.

Figure 2:
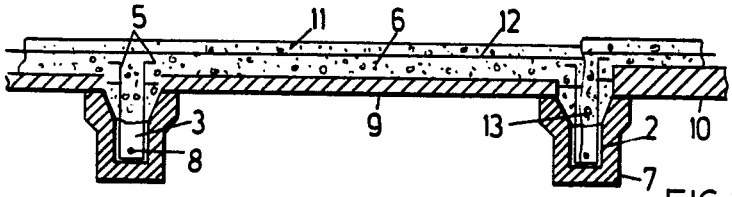

FIG. 2: shows a flooring system incorporating a pre-stressed concrete construction member according to a further embodiment of this invention.

Figure 3:
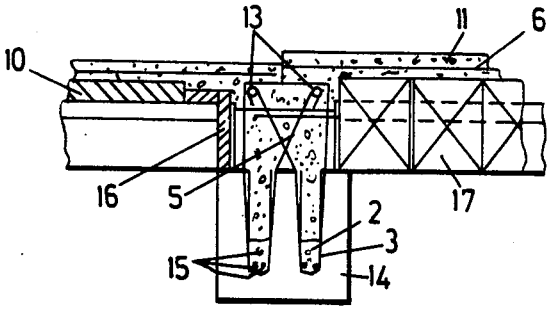

FIG. 3: shows a flooring system incorporating a further pre-stressed concrete construction member according to a further embodiment of this invention.

Figure 4:
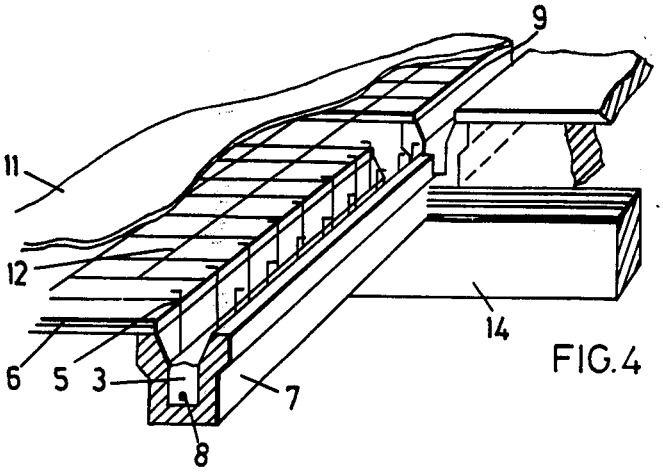

FIG. 4: shows a flooring system incorporating the pre-stressed concrete construction members of FIGS. 1 and 2.

Figure 5:
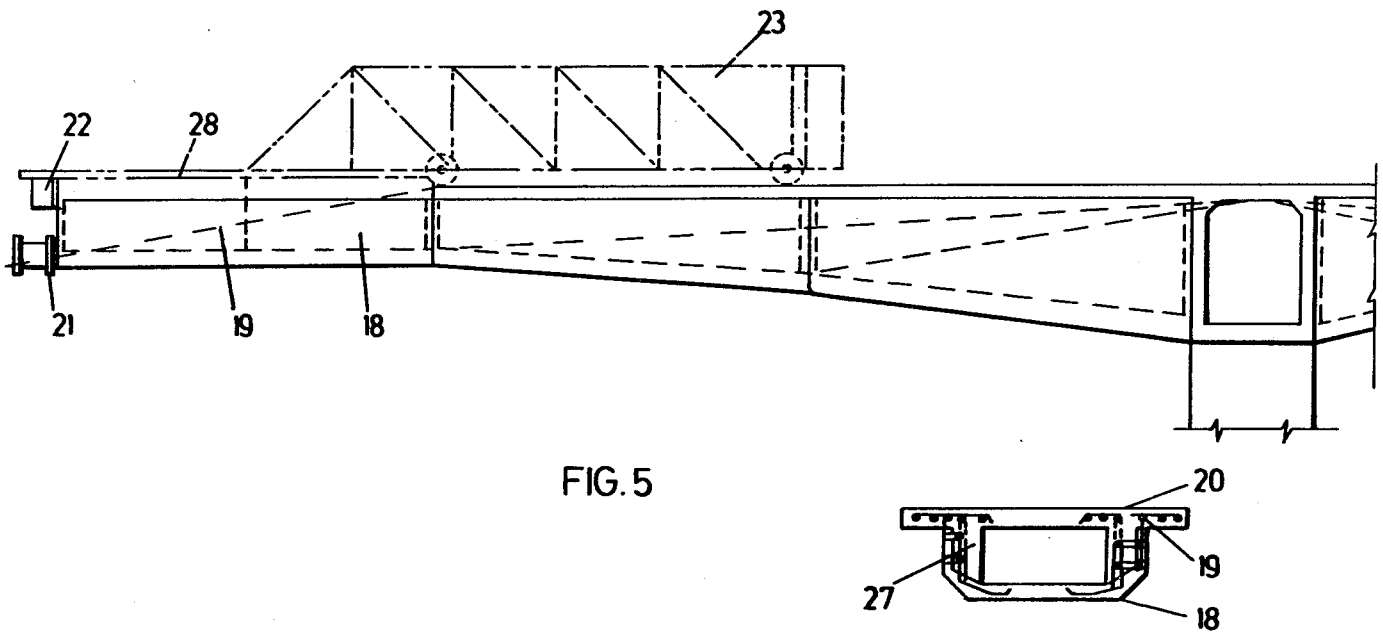

FIG. 5: shows a method of constructing a cantilever arch bridge utilizing a pre-stressed concrete construction member of one embodiment of the present invention.

Figure 6:
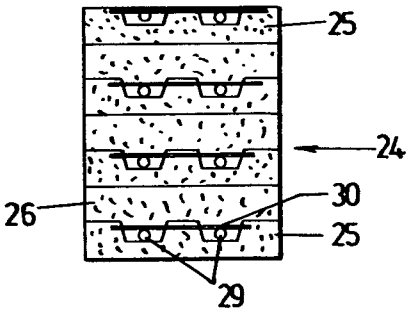
Figure 6:
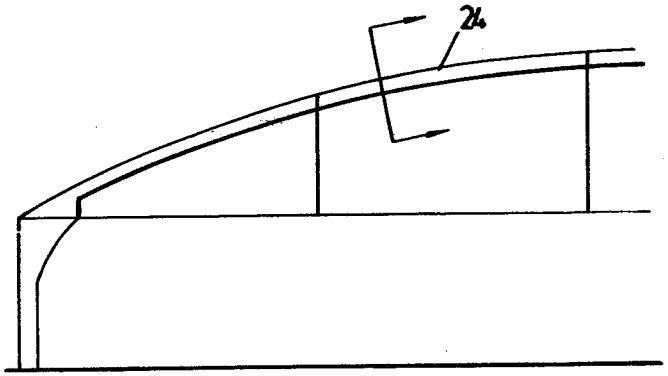

FIG. 6: shows a laminated concrete member according to a further embodiment of the invention.

The present invention may be used in the formation of any required pre-stressed concrete construction member, including, for example beams, columns, flat slabs, a pre-stressed concrete member for a cantilever bridge construction, laminated bowed arches, roading or the like.

In the manufacture of such concrete members to the present time, it has been necessary for the concrete members to occupy a pre-stressing bed for a considerable period of time, for example twenty four to forty eight hours for them to reach the desired transfer stress, which technique being both costly and time consuming and limiting with respect to the transfer stress. The present invention however, does not require a pre-stressing bed in that a pre-cast concrete element is first formed, allowed to cure for a pre-selected time and or strength and is dried out at least on or close to the surface thereof by heating or otherwise, so as to temporarily arrest the hydration process which takes place within the surface concrete, the pre-cast concrete member then being stressed by means of one or more stressing members and then being dampened prior to infilling concrete being poured therein. This process involves interrupted hydration of the cement contained in the surface layers of concrete in the pre-cast element, such that when the dried surface is dampened and infilling concrete is poured over it, hydration continues in the surface concrete of the shell and a bond of great strength is formed therebetween, the hydration process within the pre-cast concrete being reactivated by the dampening process and also by its contact with the wet newly poured concrete, a flash set occurring of the infilling concrete. The progress of cement hydration is temporarily arrested by the application of heat to the surface of the pre-cast element by which means free water is removed at a temperature below that which would cause the dehydration of calcium hydroxide, such that a bond between the pre-cast concrete element and the infilling concrete occurs during the reactivation of the hydration process. This heat radiation would preferably be in the form of the infra-red radiation of natural sunlight although if climatic conditions were not suitable then an artificial heat source such as super-heated steam could be used. The presence of voids on the surface of the pre-cast element facilitate the formation of a strong bond with the infilling concrete.

In one form of the invention, a pre-stressed concrete construction member comprises a composite construction of pre-cast and in-situ concrete elements. The pre-cast element may have at least one trough of, for example a 'U' or 'W' cross section, which pre-cast concrete element being allowed to cure after moulding for any desired period of time, for example from three to twenty eight days, and is dried out by heat, such as natural sunlight, such that the hydration process within the concrete is temporarily arrested until reactivation is required as will hereinafter be described. However, the pre-cast concrete element could be cured for only approximately eleven hours if necessary and dried out using super-heated steam, prior to stressing, dampening and infilling with the infilling concrete. The pre-cast concrete element is then stressed by means of suitable stressing members, for example a plurality of steel wires or strands, the internal surface of the aforementioned trough is then dampened with a fine water spray or the like and the interior of the trough of the pre-cast element is then filled with a layer of concrete so as to cover the one or more stressing members immediately. The dampening of the interior of the trough or troughs of the pre-cast concrete element reactivates the hydration process within the concrete thereof and a strong bond develops between the infilling concrete and the concrete on the interior surface of the trough in which, it has been found, the concrete matrix actually passes therebetween, so as to form in the resultant composite concrete member so formed, an integral bond of great strength.

The invention therefore resides in the reactivation of the hydration process in the pre-cast concrete element and also as will hereinafter be described, in the load release length of the one or more stressing members and also their relationship with the other constituent components of the concrete member. Further, and as will hereinafter be described, other important factors are necessarily taken into consideration, more particularly, the positioning within the pre-cast member of the one or more stressing members and also the amount and constituency of infilled concrete provided within the pre-cast concrete member. These further factors are determined by the modular ratio of the strengths of the concrete used for the pre-cast element and also the infill concrete and also the bond contact surface/concrete area ratio, such that when the anchor plates by which the stressing members are stressed in the pre-cast shell are removed, the stressing load is released onto the infill concrete without any subsequent cracking of the infill or any breakdown of the bond between the pre-cast shell concrete and the infill, even when allowing for the differential strength across the bond.

Upon the release of the load on the stressing members onto the infill concrete, the stressing members, namely the one or more strands or wires, move inwards from the face of the shell and expand so as to form a wedging action within the infill concrete until the load is picked up by the infill concrete. The length along which this picking up of the load occurs is herein defined as the "load release length", which term is used throughout the specification in this respect. The infill concrete strains inwards around the stressing member but outwards at its contact face with the stressing member and the shell of the pre-cast concrete element moves outwards on the release of the load placed on it by the stressing members connected to the aforementioned stressing plates or bolsters and by which the shell and the stressing members are pre-stressed. The result of this outward movement of the shell is that, at the interface of the infill and the shell for a certain distance, there is tension produced in the infill concrete this gradually reducing to a "null point", at a determined distance into the composite member, depending on the ratios aforedescribed. It has been found that it is important that the "null point" of stress between this tension area at the interface of the infill concrete and the shell is in a position forward of the centroid of the "load release length" of the stressing components. If a crack is not to occur across the infill then it has been found that the distance of the stressing members from the surface of the shell must be between one third ($\frac{1}{3}$) and two thirds ($\frac{2}{3}$) the width of the infill containing the stressing members. However, it should be understood that this rule is arbitrary and although there should always be three times the diameter of the stressing member between itself and another stressing member, a much wider range could in fact be used depending on the nature and design of the composite concrete member.

It has been found that there occurs increased ductility for the members of the composite concrete member because of the stressing pattern occurring, and more particularly, with the stress being maintained on the outside shell combined with the stressing pattern obtained from using the shell to support its total self weight, there also being a shift in the neutral axis. This causes a "pegging" action when cracking of concrete occurs and a yielding of the strands or the like of the stressing members. The result of this is an increased plastic length at failure of any member and this increased plastic length means that there is a greater energy dissipation in the yielding of the strands or the like and as external energy must equal internal energy and with the pre-stress maintained on the external face, delayed cracking causes less deflection and the beams are more ductile and actually withstand higher loads of between 10 and 20 percent of the strict theoretical load calculated from strand test strength.

This increased ductility is of particular importance when consideration of the performance of the concrete members during earthquake and similar siesmic conditions are relevant.

It has been further determined that the area of the infill concrete that is necessary to be present for the bond between the shell and the infill not to part when no allowance for the extra strength thereof due to interrupted hydration, is considered, may be calculated in the following manner:

1. 80 percent of the total load to be transferred to the infill is divided by the area of the infill.

2. The figure resulting from calculation 1 is multiplied by 0.7 times the Poisson's Ratio and then deducted from 80 percent of the load, Poisson's Ratio for concrete being calculated from the formula:

$$M=(E/2G-1)$$

where;

M = Poisson's Ratio

E = Modulus of Elasticity

G = Modulus of Rigidity

3. The figure derived from calculation 2 is then adjusted by the modular ratio of the two different concrete strengths and then divided by the infill area or the infill stress pattern calculated from it, and this answer is compared with the figure arrived at by dividing the total load applied to the shell by the shell area, this figure also being adjusted by the modular ratio of the two different concrete strengths and the resultant figures obtained must not differ by more than 50 percent.

The load in the stressing member is now divided by three times the width of the stressing members multiplied by the width of the infill and also by the length of the bond lines between the infill and the shell and the resultant bond stress must comply with the concrete regulations pertaining to the concrete member, for example those given in the A.C.I. Code in New Zealand or other regulation relating thereto in the countries concerned.

Further and with respect to the above, due to the fact that when in-situ concrete is added to the composite member so as to lift the neutral axis to the highly compressed zone in the exterior pre-cast shell, at ultimate bending condition, as aforementioned, a "pegging" action occurs to any cracking of the composite concrete member as the crack must pass through the compressed zone of the shell which lies on the neutral axis. This inhibits the yield at that particular point of the stressing wire or strand and prevents "necking" occurring. The result is that cracking of the shell occurs at another point further along the member and hence there is a greatly increased "plastic" length at failure and a drawing out yield stress of the wire or the like stressing member, which increases its ultimate load and hence that of the stressing member as a whole by between 10 percent and 20 percent.

In a typical design of a concrete floor rib member according to the present invention, 202 pounds of ⅜ granite aggregate was mixed with 76 pounds of coarse river sand and 75 pounds of fine bricklayers sand. In respect to the fine sand, the net result of a sieve analysis of the fine sand should show that at least 8 percent of the total fine sand passes a 200 mesh. The result of this is that under an output vibration of 325 horse power, the fine sand particles become thixotropic in the mix and liquify with the water already in the mix enabling the concrete to be placed in thin sections at a low water/cement ratio. The water/cement ratio is very low, in the region of 0.2 to 0.3 and thus very little heat is required to temporarily arrest the hydration therein, the temporary arrest of hydration being a condition which is variable according to the cement used, and would be in the region of 0.18 for coarsely ground portland cement but may be defined as the point at which the water/cement ratio at the bonding surface or anywhere the bonding surface can draw moisture in vapour form from, has dropped to approximately 0.18. One hundred pounds of cement and 2.7 gallons of water together with one half pound Pozzolith (trade mark) high early additive was also included in the mix and after formation of the concrete member, the member was allowed to cure and dry for three days in the sun such that at least the surface concrete of the member within the troughs formed therein was dried out so as to temporarily arrest hydration therein, the water/cement ratio in this particular mix being 0.27.

Alternatively, 11 hours of artificial heat, such as in the form of super-heated steam, could be used instead of natural sunlight.

The shell was pre-stressed to 3000 P.S.I. over the shell area of 19.8 square inches, the shell being 1⅛ inch thick at its base and 1 inch thick on its side walls, the ribs so formed being used for a floor spanning 20 feet and being designed for a loading capacity of 400 P.S.I.

The infill concrete mix was provided as 180 pounds of ⅜ granite aggregate, 65 pounds of coarse river sand and 85 pounds of fine bricklayers sand and 100 pounds of cement together with 3.8 gallons of water. The design mix of the infill concrete should be such as to give a strength approximately equal to the remaining cure strength after interruption of hydration in the shell so that hydration and shrinkage in curing will proceed along together.

After drying out of the shell as above mentioned, the shell was stressed prior to the thorough dampening or wettening of the trough surface concrete with a fine mist spray to thoroughly wetten the surface concrete but not leave water lying within the rib, the infilling concrete mix then being poured into the troughs of the rib immediately thereafter, a flash set of the infilling concrete occurring and a strong bond being developed between the surface concrete of the troughs of the shell and the infilling concrete.

A test was effected on a 20 foot span floor rib, constructed according to the present invention, and topped and finished with a 2½ inch concrete topping of concrete having a 4000 P.S.I. nominal desired strength. The strength of the concrete measured at the time of testing varied from 4,100 to 4,260 P.S.I. the width of the sample being 36 inches, being 7 inches deep, 4¾ inches wide at the base, 6¾ inches wide at the top, 1⅛ inch shell thickness at the bottom and sides, and varying from 1 inch thick along the sides to 1⅛ inch at two inches from the top, where the shell widens out as shown in the accompanying drawings. The weight of the sample as measured by a dynamometer was 1.9 tons, and was first loaded with a distributed load of 8.745 tons. Supports were provided to prevent free rocking and loading material was spaced as aforedescribed to prevent arching. The final static moment due to this load was 877.076 kip inches. From a theoretical stress block depth calculated to be 0.769 after allowing for modular ratio differences in concrete strengths a total steel force of 101.9857 was calculated and deducting the load carried in the shell wire mesh and dividing this figure between the two strengths, the load per strand was shown to be 50.314 kips/strand. The breaking load of the strand as specified by the manufacturers was 39.4 kips, the overload therefore under static conditions being 27.7 percent of the manufacturers specification of breaking load. At a point just beyond the theoretical ultimate load of the unit with the addition of the last load, the test unit showed signs of steel yielding, deflections gradually increasing without further addition of load and cracks generally along the crack length began to widen. However, after about 2 inches deflection in this manner this yielding slowed down and ceased. The load was therefore rearranged and concentrated towards the centre of the unit so as to increase both moment and shear. The unit withstood these additions with only normal elastic deflection which would be expected with the increase in load. With a final concentration of load totally in the centre of the span, excepting for a 1.03 ton load 4 foot long added either side of the mid-span load, the deflection of the unit remained stable. An attempt to break the unit by raising and lowering a top pallet of load which weighed 1.605 tons approximately 15 inches and dropped at a speed of 250 feet per minute, in accordance with the natural period of the unit, resulted only in upward and downward deflections of approximately 2½ inches of the member with very little apparent damping. The unit withstood this dynamic loading for several minutes and upon removal of the load, cracks within the member appeared to close but there remained a gap of approximately 1/32 inch in most cracks. the initial cracking point was at 77.8 percent of theoretical ultimate load calculated from the breaking load of the strand and the cracking length was 12 foot 6 inches and the units during the plastic yield stage hereinbefore described seem to yield fairly evenly along this length although two cracks were clearly wider in the central zone. It is concluded from the above and similar tests conducted that the aforementioned "pegging" action occurs and the extra plastic length gained from this allows for further restraining of the wire and an increased total load capacity as indicated by a test load on a strand from the unit which showed a breaking load of approximately 46.5 kips but which broke in the grips due to being "nicked" by the grips during the test.

Referring now to the accompanying drawings, and more especially to FIG. 1, a cross section of a part of the pre-cast lower shell of a concrete slab 1 is shown in which a plurality of troughs of a substantially rectangular cross section 2 are provided therein. The pre-cast shell 1 is allowed to cure for a pre-selected time and the concrete at least on the trough surface layers of the shell dried out by natural sunlight or other heat source, so as to temporarily arrest the hydration process of the concrete therein. The stressing members 4 are then placed within the pre-cast concrete shell 1 and stressing plates are mounted at either end and stress placed on the stressing members and hence on the pre-cast shell 1. A concrete setting retarding agent, for example SIK NOL (Trade Mark), which is a weak sulphate solution may be spread over the inside surfaces of the troughs 2 after forming but is washed off to expose the aggregate within the troughs prior to drying out and prior to the stressing members being stressed. The concrete on the inside surface of the troughs 2 is now thoroughly dampened with a fine spray of water, and a layer of infilling concrete 3 is then poured thereover immediately so as to cover the stressing members 4, the dampening of the inside surfaces of the troughs 2 reawakening the hydration process which enables a strong bond to develop between the infilling concrete and the concrete surfaces of the troughs 2, a flash set occurring in the infilling concrete. Projecting stirrups 5 extend outwardly from the infilling concrete layer 3 which will project inside and be covered by topping up concrete which is poured thereover so as to form the required flooring or wall system shown in FIG. 1. After the curing of the composite concrete slab including the infilling concrete 3, it may then be placed in position in a flooring system and topping and infill concrete poured in-situ over the concrete slabs, which further concrete layer being indicated by reference numeral 6 in the FIG. 1. The upper surface of the infill concrete 3 within the trough 2 of the pre-cast slab former 1 is shown to be roughened so as to enhance the bonding between the infill concrete 3 and the in-situ concrete 6.

Referring now to FIG. 2, numerals corresponding to those used in FIG. 1 being used in this figure where appropriate, a concrete beam 7 is provided having a substantially rectangular trough 2 therein at least the surface layer of concrete of which has been dried out as aforedescribed, and is filled with a layer of infill concrete 3 in the manner aforedescribed, such that upon the reactivation of the hydration process in the pre-cast rib 7 a strong bond develops between the pre-cast rib 7 and the infill concrete 3, stirrups 5 being shown extending outwardly from the infill concrete 3 which stirrups are then covered over by an in-situ pour of concrete 6 and a topping layer of concrete 11. Tiles 9 are shown being supported by the pre-stressed concrete ribs 7 and alternative types of tiles 10, for example lightweight tiles, are shown also provided within the flooring system. Reinforcement mesh 12, for example H.R.C. 668 mesh or heavier, for example is shown laid between the topping concrete layer 11 and the infill concrete in-situ layer 6. Anchorage or saddle bars 13 are also provided within the in-situ infill concrete layer 6 and extending along the rib 7.

Referring now to FIG. 3, of the accompanying drawings, a pre-cast concrete shell having a 'W' cross section 14 is shown provided with troughs 2 therein within which troughs 2 the infill concrete layer 3 and the stressing members 15 are placed in the manner aforedescribed prior to the in-situ layer of infill concrete 6 and the topping layer of concrete 11 and the reinforcement mesh 12 being mounted thereover. Tiles 10 are also shown provided for the floor system in FIG. 3 together with a substantially 'L' shaped end tile 16 abutting against an upper surface of the 'W' shaped concrete beam 14. Stirrups 5 are shown extending outwardly and hooked over anchorage bars or the like 13 provided in the in-situ concrete layer 6.

Blocks 17 are shown provided extending from one side of the 'W' concrete beam 14 which blocks being provided with substantially hollow cores for ducting and reticulation purposes.

Referring now to FIG. 4 of the accompanying drawings, a floor system is shown in a partly exploded perspective view, with the 'W' concrete beams 14 extending orthogonally relative to the pre-cast concrete ribs 7 with the tiles 9, the in-situ concrete layer 6, the reinforcement mesh 12 and the topping concrete layer 11 provided thereover. The infill stirrups 5 are shown extending outwardly from the infill layer 3 provided within the trough formed in the ribs 7 as aforedescribed.

The accompanying drawings show the incorporation of concrete construction members in a building system, for example a floor system, although it is to be understood that the invention resides in the method of manufacture of the concrete members wherein interrupted hydration of a pre-cast concrete element enables a strong bond to develop between the infill concrete and the surface concrete of at least part of the shell, and in which a bond inter-face is provided between the pre-cast concrete member and the infill concrete in which matrix from both the pre-cast concrete element and the infill concrete inter-link to form a bond of great strength. It improves the fusion if aggregate is gently pressed into the shell surface immediately after casting. Thus, it is a necessary feature of this invention that the hydration process taking place within the pre-cast concrete element is temporarily arrested at a required stage by the application of heat such as natural sunlight and reawakened upon the pouring therein of the infill concrete such that this strong bond develops therebetween.

Referring now to FIG. 5 of the accompanying drawings, a cantilever bridge construction is shown which utilizes light shells to take the initial lift and construction load, the last shell 18 being shown mounted in position and which shell is then dry cured preferably by means of a heat source such as natural sunlight in the manner aforedescribed with reference to the previous figures, prior to stressing, dampening and covering with a layer of infilling concrete 27 and deck concrete 20, which infilling concrete 27 forming a bond with the pre-cast concrete shell 18 by means of the interrupted hydration of the shell 18 as hereinbefore described. The stressing strands 19 of the deck 20 of the bridge construction are successively turned down as shown and are anchored at an anchoring position 21, until the infill concrete 27 and deck concrete 20 has been cured, for example steam cured, a top anchor bolster 22 being shown provided for stressing the deck reinforcement wires and stressing bolster support arms 28 also being shown provided.

A movable and temporary shell support 23 is shown which supports the shell 18 by means of counter weights in known manner until the shell 18 has been secured in position in the cantilever bridge construction. A covering of a suitable insulation, for example SIZALATION (Trade Mark), is provided over the shell 18, during the aforementioned dry cure process. The weight of the section of the bridge construction which has to be lifted into position is therefore much lighter and hence much larger sections can be lifted at any one time. Further, any desired pre-load stress pattern can be achieved by pre-selecting the locations from which the stressing members 19 are dropped down from the deck section 20, through protruding steel reinforcement loops and before the pouring of the site, infill and deck concrete.

Referring now to FIG. 6 of the accompanying drawings, a laminated pre-stressed concrete member 24 is shown, which in this form of the invention is bent over so as to form an arch for bridge work or other building construction.

The laminated concrete member comprises a plurality of pre-cast shells 25, which are mounted together and spaced apart one from the other by means of infill concrete 26, the infill concrete 26, being provided with reinforcement, for example fibrous reinforcement such as fibreglass or meshlike reinforcement such as chicken netting. Other types of reinforcement could of course be used for the infill concrete.

The laminated concrete member 24 is formed within a mould with each shell 25 being dry cured as aforedescribed and pre-stressed by means of stressing members 29 prior to dampening and the provision of a layer of infill concrete thereover and the subsequent provision of a further dry cured shell 25 so as to form the laminated or sandwich type concrete member 24 shown in the figure. The dry curing of at least the trough surfaces of each of the shells 25 prior to the pouring of the infill concrete provides for the fusion of the infill concrete 26 with the respective surfaces of the dry cured shells 25, by means of the reawakening of the hydration process as hereinbefore described. Retaining members 30 are also shown provided within the shells 25 which retain the stressing members 29 in their required position.

In the figure shown, the.laminated member is formed into an arched concrete member 24 which is formed by the bending round of the pre-cast concrete shells 25 after stressing thereof, each of the shells then being fused with the reinforced infill concrete layers 26, to provide an arch of the required curvature for bridge work or other building construction and which concrete arch is of a considerable strength and in which the stressed pre-cast shells 25 are fused together by means of the interrupted hydration of the bonding surfaces of the pre-cast shells in a manner hereinbefore described.

It is envisaged that the present invention could be utilized in the construction of a pre-stressed concrete member, which would be provided with a hollow, for example cylindrical, pre-cast concrete shell into which the infilling concrete is poured after drying of at least the inner surfaces of the hollow shell as aforedescribed.

Although this invention has been described by way of example and with reference to preferred embodiments of the invention it is to be understood that modifications and improvements may be effected thereto without departing from the scope of the invention as defined by the appended claims.

I claim:

1. A method of forming a pre-stressed concrete member comprising:

forming a concrete shell with at least one inner trough;

curing said concrete shell sufficiently to permit the shell to withstand stress;

drying out at least the inner surface of said trough so as to temporarily arrest hydration therein;

locating at least one stressing member within said trough, in stress-application relationship therewith, and stressing said member so as to stress the shell;

dampening said inner surface of the trough;

infilling the trough with concrete so as to cover the stressed member; and allowing the infilling concrete and the concrete shell to cure concurrently.

2. A method of forming a pre-stressed concrete member comprising:

forming a concrete shell with at least one inner trough;

applying a concrete setting retarding agent over inner surfaces of said trough(s);

curing said concrete shell sufficiently to permit the shell to withstand stress;

exposing the concrete of said inner surface of said trough;

drying out at least said inner surface of said trough so as to temporarily arrest hydration therein;

locating at least one stressing member within said trough, in stress-application relationship therewith, and stressing said member so as to stress the shell;

dampening said inner surface of the trough;

infilling the trough with concrete so as to cover the stressed member; and allowing the infilling concrete and the concrete shell to cure concurrently.

3. A method of forming a pres-stressed concrete member comprising:

forming a concrete shell with at least one inner trough;

curing said concrete shell sufficiently to permit the shell to withstand stress;

drying out at least the inner surface of said trough so as to temporarily arrest hydration therein;

locating at least one stressing member within said trough, in stress-application relationship therewith, and stressing said member so as to stress the shell;

dampening said inner surface of the trough;

infilling the trough with concrete so as to cover the stressed member;

allowing the infilling concrete and the concrete shell to cure concurrently;

providing further concrete shells formed, cured and dried out in at least the inner surfaces of the troughs thereof and infilled with concrete; and said infilling concrete interconnecting such shells so as to form a laminated concrete member.

4. A method of forming a pre-stressed concrete member comprising:

forming a concrete shell with at least one inner trough;

curing said concrete shell sufficiently to permit the shell to withstand stress;

drying out at least the inner surface of said trough so as to temporarily arrest hydration therein;

locating at least one stressing member within said trough, in stress-application relationship therewith, and stressing said member so as to stress the shell;

dampening said inner surface of the trough;

infilling the trough with concrete so as to cover the stressed member;

allowing the infilling concrete and the concrete shell to cure concurrently;

roughening an outer surface of said infilling concrete;

pouring an in-situ layer of concrete over said roughened surface; and providing further stressing members within said layer of infilling concrete which extend outwardly therefrom to be covered over by said in-situ pour of concrete.

* * * * *